US006840894B2

(12) United States Patent
Lerner

(10) Patent No.: US 6,840,894 B2
(45) Date of Patent: Jan. 11, 2005

(54) MODULAR RESISTIVE EXERCISE SYSTEM

(76) Inventor: Louis L. Lerner, 900 Lake Shore Dr., Chicago, IL (US) 60611

( * ) Notice: Subject to any disclaimer, the term of this patent is extended or adjusted under 35 U.S.C. 154(b) by 32 days.

(21) Appl. No.: 10/356,819

(22) Filed: Feb. 3, 2003

(65) Prior Publication Data

US 2004/0152569 A1 Aug. 5, 2004

(51) Int. Cl.[7] ..... A63B 21/00
(52) U.S. Cl. ..... 482/124; 482/121; 482/126
(58) Field of Search ..... 482/124, 105, 482/13, 127; 602/23

(56) References Cited

U.S. PATENT DOCUMENTS

| | | | | | |
|---|---|---|---|---|---|
| 1,618,273 | A | * | 2/1927 | Davidson | 482/124 |
| 2,160,722 | A | | 5/1939 | Cunningham | |
| 4,245,840 | A | | 1/1981 | Van Housen | |
| 4,428,577 | A | | 1/1984 | Weingardt | |
| 4,456,249 | A | | 6/1984 | Calabrese | |
| 4,588,186 | A | | 5/1986 | Calabrese | |
| 5,258,017 | A | | 11/1993 | Myers et al. | |
| 5,362,295 | A | * | 11/1994 | Nurge | 482/13 |
| 5,588,941 | A | | 12/1996 | Scott | |
| 5,752,900 | A | * | 5/1998 | Holland, Jr. | 482/124 |
| 5,836,857 | A | | 11/1998 | Jennings | |
| 5,857,945 | A | | 1/1999 | Papp et al. | |
| 5,921,903 | A | | 7/1999 | Lawrence | |
| 5,984,845 | A | | 11/1999 | Powers | |
| 6,071,218 | A | | 6/2000 | Tepperberg | |
| 6,099,447 | A | * | 8/2000 | Ramsaroop | 482/127 |
| 6,428,495 | B1 | * | 8/2002 | Lynott | 602/23 |
| 6,450,926 | B1 | | 9/2002 | McKernan | |
| 6,450,930 | B1 | | 9/2002 | Kroke | |

* cited by examiner

*Primary Examiner*—Jerome W. Donnelly
(74) *Attorney, Agent, or Firm*—Olson & Hierl, Ltd.

(57) ABSTRACT

A modular, resistive, limb-muscle exercise system is disclosed comprising: (a) a torso anchoring module configured for encircling and being adjustably secured around a selected portion of a person's torso; (b) at least one limb extremity-receiving module; and (c) at least one elongate resilient module having a proximal portion being adapted for placement in operative association with module (a) and a distal portion adapted for placement in operative association with module (b), the resilient module being linearly positioned relative to the limb of the received limb extremity to provide a variable, resistive tension to the muscles of the limb associated between module (a) and module (b) during exercise of the associated limb. A kit embodiment and exercise method is also disclosed. The modular resistive limb-muscle exercise system is particularly suitable for use by physically challenged persons.

15 Claims, 5 Drawing Sheets

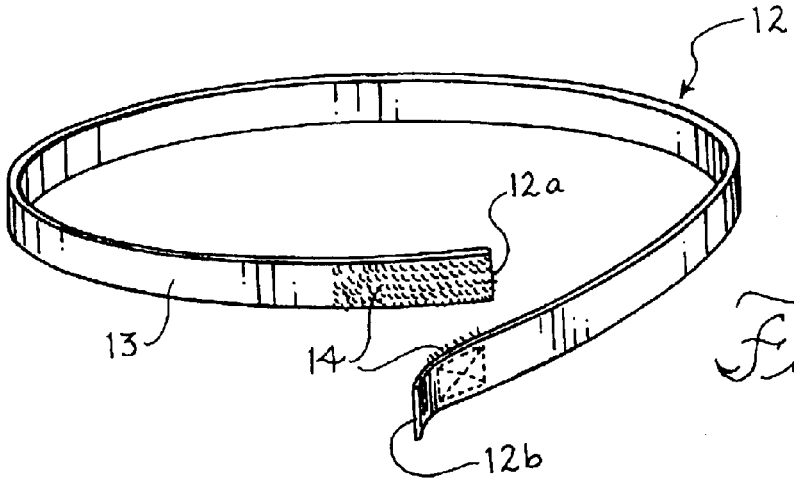
Fig. 1c
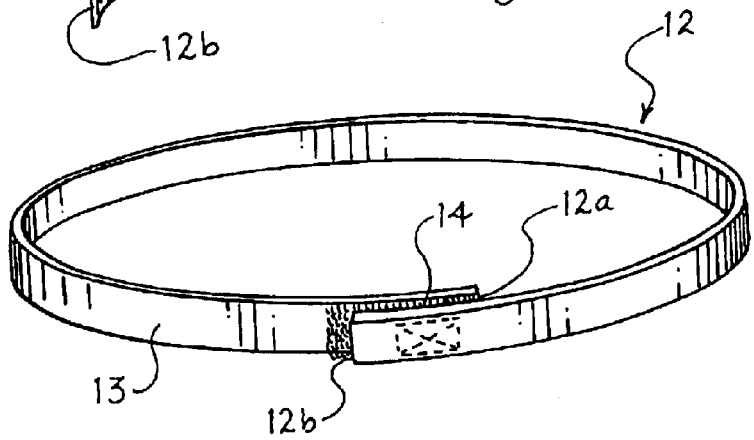
Fig. 1d
Fig. 2
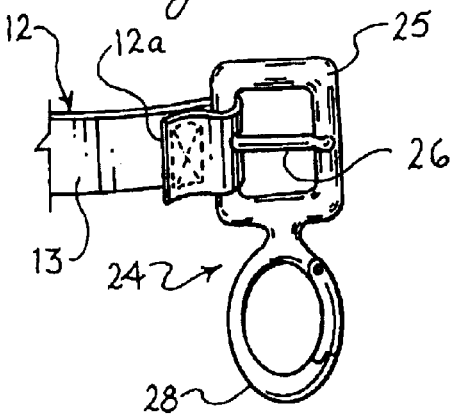
Fig. 2a
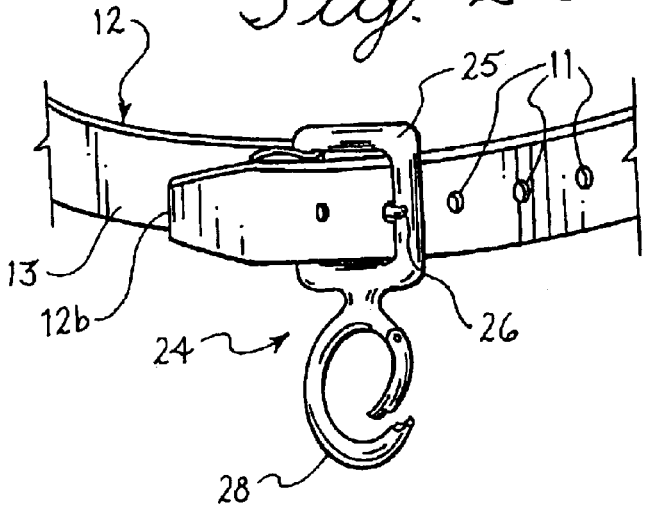

Fig. 3
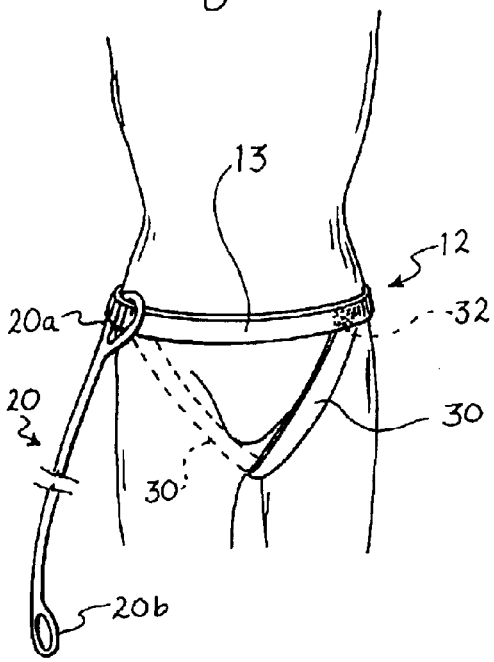
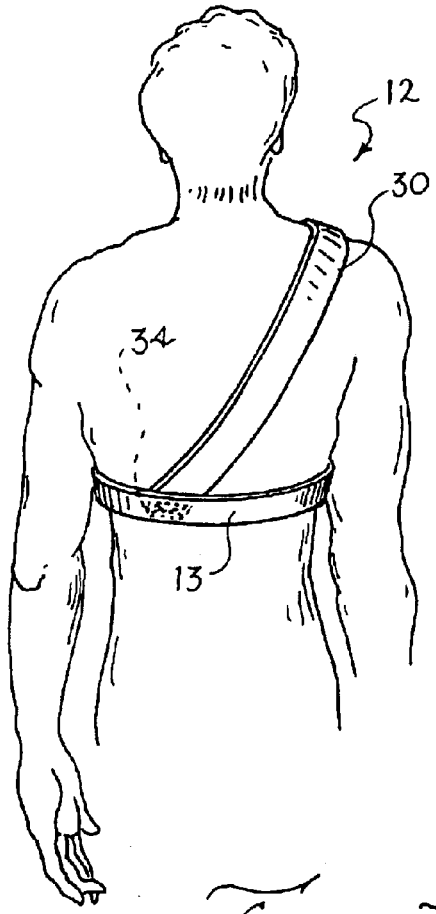
Fig. 3a
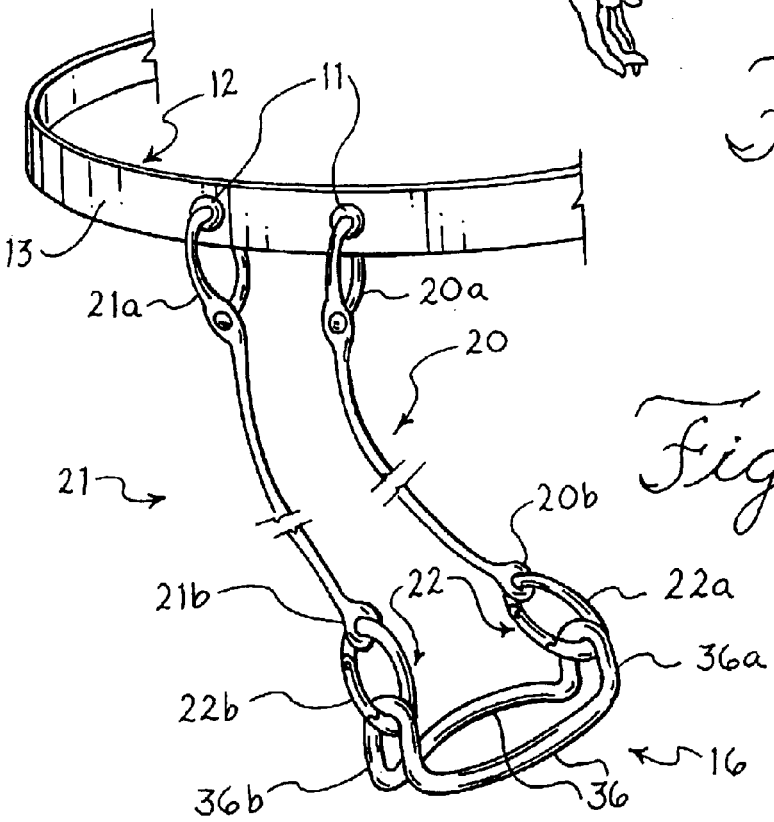
Fig. 4

Fig. 5
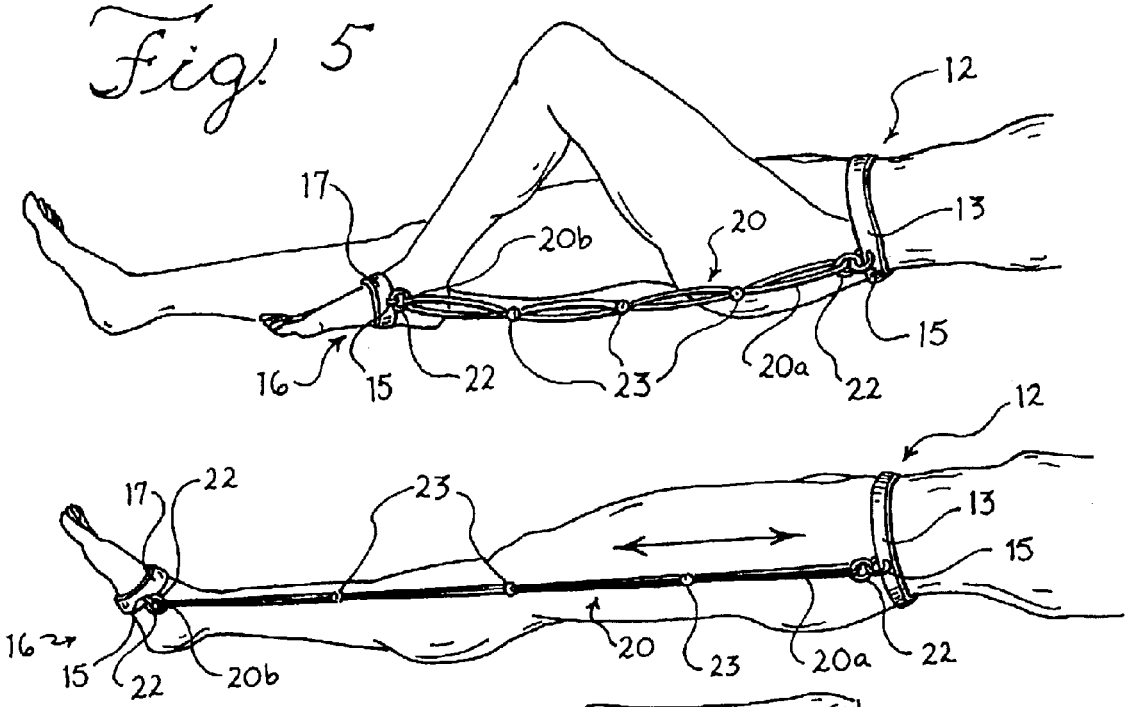
Fig. 5a
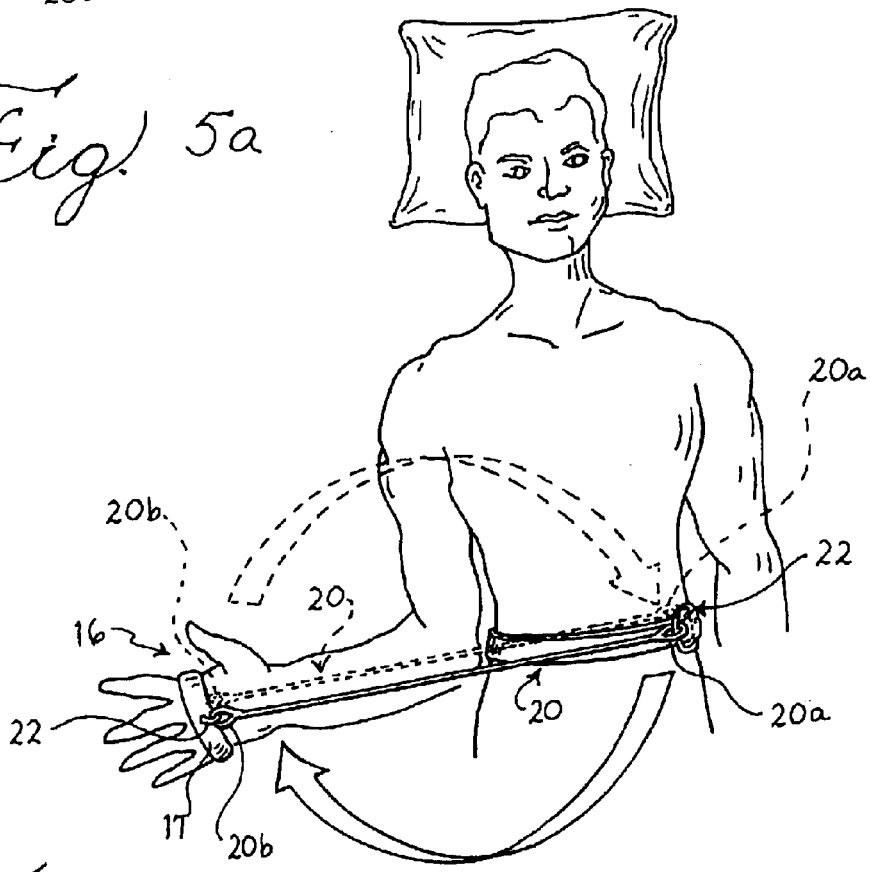
Fig. 6

Fig. 7
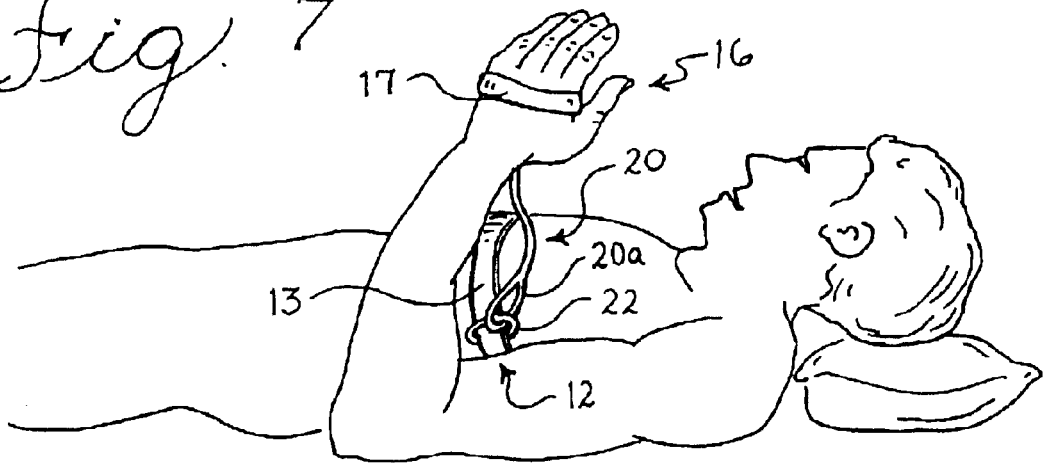
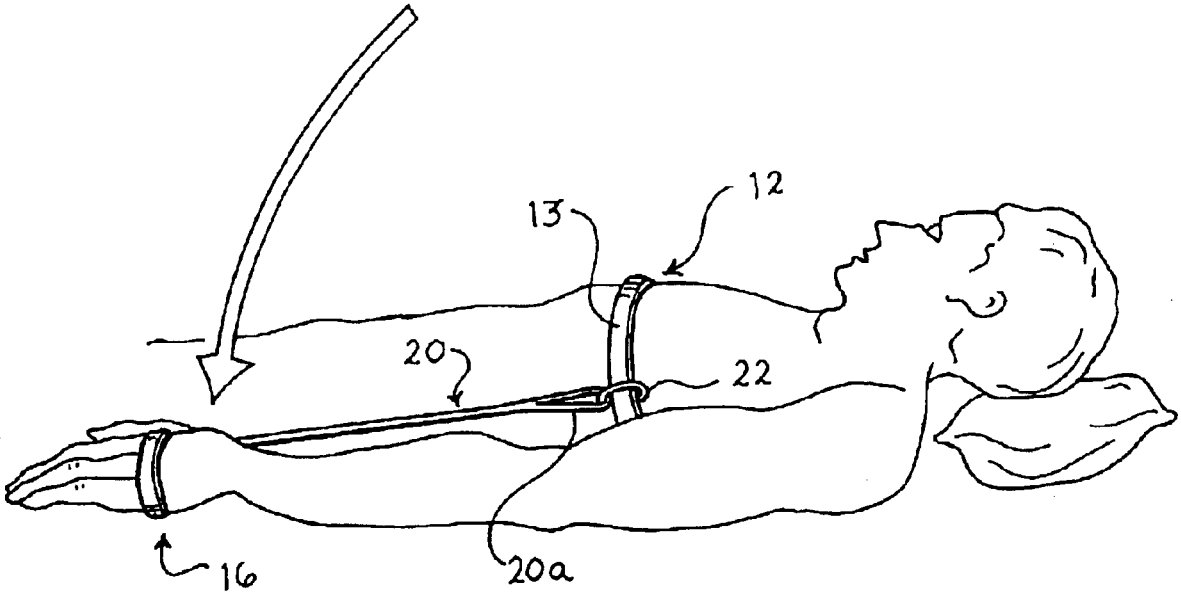
Fig. 7a

MODULAR RESISTIVE EXERCISE SYSTEM

TECHNICAL FIELD OF THE INVENTION

This invention relates generally to exercise devices, and, in particular, to a modular, resistive exercise system and apparatus therefor and method for exercising the limb muscles of the body.

BACKGROUND OF THE INVENTION

The importance of maintaining good physical fitness and preventing wasting of the limb muscles is well known. In particular, the limb muscles of physically challenged persons who are physically immobile or incapacitated from infirmity and are bedridden or wheelchair bound are prone to wasting and atrophy for lack of sufficient exercise. Physically challenged persons can also include persons who are physically inactive due to sedentary lifestyles or working conditions, elderly persons having limited mobility, and persons living in confined quarters, such as cells, marine crafts, or space crafts, where limited physical mobility can result in loss of limb muscle strength.

There is an increasing public awareness of the need for physical fitness and the importance of regular exercise for enhancing health and prolonging life. This is evidenced by the increasing availability of health centers, exercise devices, and health awareness publications.

Mechanical exercise devices generally known in the prior art consist of complex apparatus, such as treadmills, bicycles, rowing machines, weight lifting machines, and the like, that require the user to be sufficiently mobile and able to exert the effort required for using the apparatus. Such exercise apparatus and devices are also costly and require considerable spatial area for both usage and storage.

Numerous non-mechanical passive exercise devices are also known in the prior art, such as barbells, ankle weights, and exercise bands, but most of these are not suitable for use by the feeble elderly, infirm or invalid person. For example, barbells require that the user have good hand gripping acumen and sufficient hand grasping strength, which elderly, infirm, and invalid persons usually lack. Ankle weights likewise require that the user have sufficient bodily flexibility and hand dexterity to manipulate the weights for attachment and detachment, which the elderly, infirm, and invalid, often lack. Some exercise bands are frequently anchored to some stationary object, such as a doorknob, furniture (i.e., a chair leg), or a fixed structure, such as a wall, to provide sufficient lateral resistance, but these devices also typically require that the user be sufficiently agile and mobile to exert the considerable force required, and would not be suitable for use by the bedridden.

Some prior art elastic or flexible exercise apparatus and devices are known that can be held with both hands for pulling, but these devices require considerable hand gripping strength or bodily contortion or both. Other prior art devices require that the user exert force simultaneously using both the hands and feet in order to provide sufficient resistance. In some cases, the exercise apparatus induces undesirable traction or force on the spine, either intentionally or indirectly.

There is an ongoing need, therefore, for an economical, compact, limb-muscle exercise apparatus suitable for use by physically challenged persons, and an exercise system that can be easily custom designed by either the user, or caregiver, to both linearly fit the physique and accommodate the variable limb-muscle exercise needs of the user. The modular, resistive exercise system and apparatus of this invention answers this need.

SUMMARY OF THE INVENTION

Disclosed is a modular, resistive, limb-muscle exercise system, apparatus and kit therefor, and exercise method.

The modular resistive, limb-muscle exercise system of the present invention comprises:

(a) a torso anchoring module configured for encircling and being adjustably secured around a portion of a person's torso;

(b) a limb extremity-receiving module; and (c) at least one elongate resilient module having a proximal portion and a distal portion, and adapted for placement in operative association with module (a) at the proximal portion and in operative association with module (b) at the distal portion. The resilient module is linearly configured to provide variable, resistive tension between module (a) and module (b) and to the limb muscles during exercise of the limb associated with the received limb extremity.

In one preferred modular resistive limb-muscle exercise embodiment, the torso anchoring module (a) can be a band or belt having a panel, and a first free end portion and a second free end portion for releasably associating with one another to adjustably secure module (a)around a person's torso. A preferred torso anchoring module includes a releasable, sealable closure for adjustably securing the first and second free ends together and positioning the torso anchoring module around the trunk of a person in need of exercise. The limb extremity-receiving module (b) also can be a band or belt configured in a form and manner substantially similar to the torso anchoring module as described above, and is dimensioned to releasably receive either a person's hand or a person's foot. A preferred limb extremity-receiving module encircles the limb extremity (i.e. foot or hand) of the person in need of exercise and includes a releasable, sealable closure for adjustably securing the first and second free end portions together and positioning the limb extremity-receiving module.

In the foregoing preferred modular apparatus embodiment, the resilient module (c) can be placed in operative association with the torso anchoring module (a) and limb extremity-receiving module (b) by employing a resilient module (c) having loop-shaped proximal and distal end portions, each of which, respectively, can be either slidably received on or knotted onto the panel portion of module (a) and the panel portion of module (b).

In another preferred modular resistive limb-muscle exercise embodiment, a connector module can be used to operatively associate the resilient module (c) with either one of torso anchoring module (a), limb extremity-receiving module (b), or both. Alternatively, each one or both of the torso anchoring module (a) and limb extremity receiving module can include an attachment mount defined therein or disposed thereon with which the respective proximal and distal ends of the resilient module (c) can be associated. Another preferred limb extremity-receiving module embodiment can include a grip member for grasping by the foot or hand of the received extremity.

The apparatus of the inventive modular resistive limb-muscle exercise system can be linearly customized by the user, or the user's caregiver, to fit the physique of the user and can be designed to accommodate the specific exercise needs of the user. The muscles of the upper limb and lower limbs can be resistively exercised, independently, with the modular resistive limb-muscle exercise system of this invention. The apparatus for the modular resistive limb-muscle exercise system can be provided in a kit, as individual module components, which can be readily assembled for use and disassembled for storage by a user or the user's caregiver.

A preferred resistive limb-muscle exercise method regimen embodiment comprises the following steps:

(i) Modules (a), (b) and (c) are provided or placed in operative association with one another, with the length and resiliency of resilient module (c) having been selected to provide a predetermined level of resistive tension when tension is applied between modules (a) and (b) during exercise by the user in step (iv);

(ii) Module (a) is adjustably secured around a portion of the torso of the person in need of exercise, preferably around or near the hips for lower limb muscle exercise, or around or near the midchest ribcage for upper limb muscle exercise;

(iii) The person's selected limb to be exercised is placed in flexion relationship with the person's torso and the associated limb extremity is received in module (b), with substantially no tension being applied to the resilient module (c), linearly aligned between modules (a) and (b); and (iv) Variable tension is applied to the resilient module (c) by extending and flexing the selected limb repeatedly and sufficiently to provide a discernible resistive tension to the muscles of the selected limb.

The level of resistive tension provided in practicing the exercise method can be varied by initiating the exercise with a resilient module (c) having one level of selected resistive tension, and then periodically replacing the resilient module (c) with a resilient member having a greater or lesser level of resistive tension relative to that of the resilient member initially used. Thus, the user's limb muscles can be gradually strengthened through an exercise regimen and apparatus that is custom designed to accommodate the need of the person, thereby avoiding undue muscular stress or undesirable strain.

The resistive limb-muscle exercise system is particularly suitable for use by physically challenged persons who are in need of preventing limb muscle wasting or for rehabilitating an injured limb muscle. Advantageously, the inventive limb-muscle exercise system can be used by persons in a recumbent position making it particularly suitable for providing resistive exercise to the muscles of either of the upper or lower limbs of persons who are bedridden and the elderly. In particular, the interchangeability of the modules allows either the user, or the user's caregiver, to customize the level of resistive tension and linearity of the apparatus to accommodate the person's physical needs. Further, the weight of the user's own torso provides the counterweight for producing the resistive tension during usage, thereby avoiding undesirable strain or tension to the neck or traction on the spine, and eliminating the need for external stationary anchors, such as doorknobs, furniture legs, fixed structures, and the like.

Another benefit is that the method of exercising the limb muscles with the resistive limb-muscle exercise system can be performed by wheelchair-bound persons, and by persons having limited exercise areas. Still another benefit is that the module elements of the modular device can be readily assembled for usage and readily disassembled for storage, making the limb-muscle exercise system compact, portable, and economic. Further, the versatile, resistive limb-muscle exercise system can be adapted for use by persons of either sex, of any girth or stature, and of any age.

Other aspects and advantages of the present invention will be apparent from the description of the preferred embodiments below made with reference to the drawings.

BRIEF DESCRIPTION OF THE DRAWINGS

In the drawings,

FIGS. 1*c* and 1*d*, each illustrate a perspective view of a preferred torso anchoring module embodiment and closure member in open and releasably sealed relationship, respectively;

FIG. 2 is a partial plan view of a preferred connector module including a closure member;

FIG. 2*a* is another partial plan view of the connector module shown in FIG. 2 with the closure member in releasably sealed relationship;

FIG. 3 is a front view illustration of portion of a preferred modular resistive limb-muscle exercise system embodiment for lower limb muscle exercise having a support member;

FIG. 3*a* is a back view illustration of a portion of a preferred modular resistive limb-muscle exercise system embodiment for upper limb muscle exercise having a support member;

FIG. 4 is a partial, perspective view of a preferred modular resistive limb-muscle exercise system embodiment having a pair of resilient modules;

FIGS. 5 and 5*a* each are side view illustrations of the use of a preferred modular resistive limb-muscle exercise system embodiment for exercising the lower limb muscles;

FIG. 6 is a top plan view illustration of another use of a preferred modular resistive limb-muscle exercise system embodiment for exercising upper limb muscles; and FIGS. 7 and 7*a* each are side view illustrations of the use of a preferred modular resistive limb-muscle exercise system embodiment for exercising the upper limb muscles.

DESCRIPTION OF PREFERRED EMBODIMENTS

As used herein, the term "limb" refers to either one of the arm or leg appendages of the human body inclusive of the attendant components parts of each respective appendage. The term "limb extremity" refers to the distal or terminal portion of an arm or leg, such as the hand or foot, respectively. The term "limb muscle", and grammatical variations thereof, refers to the muscles of the associated upper or lower limb, e.g. arm or leg, respectively. The term "torso" includes the portion of the trunk below the neck from the shoulders to the groin.

Figure 1:
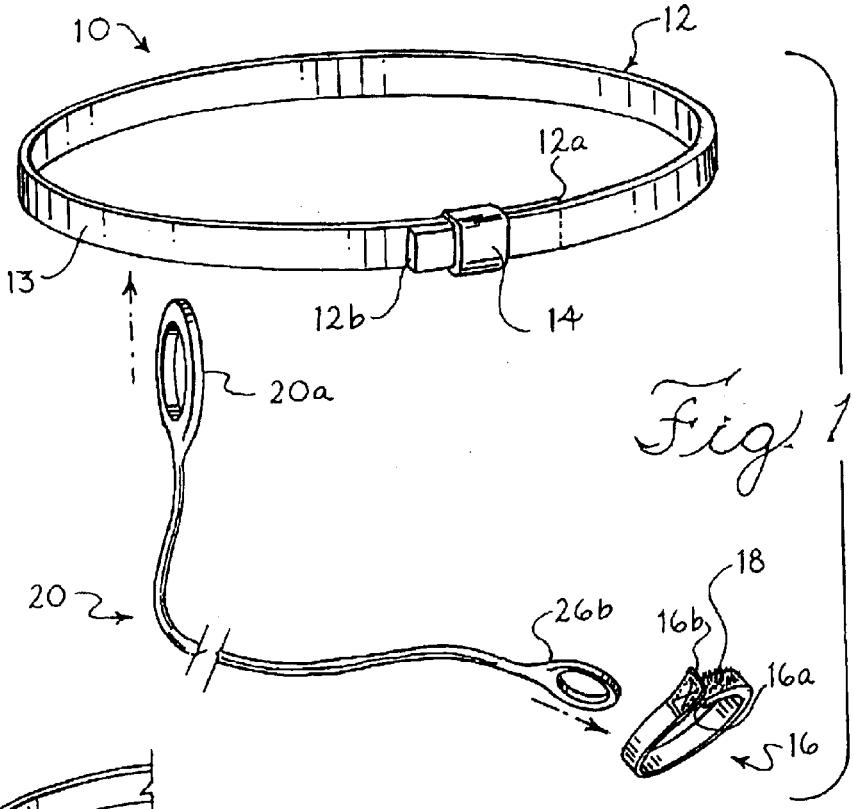
FIG. 1 is an exploded, perspective view of a preferred modular, resistive limb-muscle exercise system of this invention.

FIG. 1 shows an exploded view of a preferred embodiment of a modular, resistive limb-muscle exercise system 10 of the present invention. As illustrated, the modular apparatus comprises a torso anchoring module 12, a limb-extremity receiving module 16, and a resilient module 20.

The torso anchoring module 12 can be a cord, band, or belt, having a first free end and a second free end, that can encircle and be releasably secured around a portion of a person's torso as seen generally in FIGS. 3, 3*a*, 5, 5*a*, 6, 7, and 7*a*, and be adjusted to provide a comfortable, yet secure fit. For exercising the upper limb muscles, the torso anchoring module is preferably configured and dimensioned to encircle the ribcage of the chest, preferably at the midchest or upper chest between the armpits and the waist as seen generally in FIGS. 3*a*, 7 and 7*a*. For exercising the upper limb muscles associated with the upper arm and shoulder area, such as in rehabilitating a shoulder-cuff injury, the torso anchoring module can be aligned on the torso at or about the elbow as illustrated in FIG. 6.

For exercising lower limb muscles, the torso anchoring module is preferably configured and dimensioned to encircle the hips, preferably between the waist and the groin, as seen generally in FIGS. 3, 5 and 5*a*. Preferably, the portion of the torso selected for attachment of the torso anchoring module utilizes the person's own body as the stabilizing counterweight for achieving the resistive tension to be applied to the selected limb when the apparatus is fully assembled for usage. For example, the torso anchoring module is preferably secured around the abdomen and buttocks or around the midchest where the weight of the person exercising in a prone or recumbent position, lying on a bed or exercise mat, is usually maximal, as generally seen in FIGS. 5, 5*a*, 6, 7 and 7*a*.

The torso anchoring module 12 preferably can be made from a fabric (woven or nonwoven), a leather (natural or synthetic), a polymeric material, such as nylon, polypropylene, and the like, a web, such as a mesh or braiding, or a combination thereof. The dimensional width of the torso anchoring module can be any practical size, but preferably is not more than about three inches, more preferably is in the range of about one inche to about two inches. The torso anchoring module 12 can be adjusted and closed by simply looping and tying together the first free end and the second free end. Preferably, the torso anchoring module includes a suitable quick release closure.

Turning to FIG. 1, a non-limiting embodiment of the torso anchoring module 12 is illustrated as a band or belt having a first free end 12*a*, a second free end 12*b*, a panel 13, and a closure 14 for placing the free ends 12*a* and 12*b* in releasable sealed association with one another.

The closure member can be any type of temporary, quick release fastener. For example, as illustrated in FIGS. 1*c* and 1*d*, the closure 14 can be, without being limited thereto, a sufficient strip of a self-sealing hook and loop fastener tape, such as VELCRO® tape, disposed at the first free end 12*a* and second free end 12*b* of the panel 13 to provide an adjustable fit. Alternatively, the closure 14 can comprise snaps, hooks, tabs, such as a button and buttonhole tab, rings, such as "D-rings", buckles (frame and tongue type or friction hold type, clasps, and the like), or a combination of the foregoing, so long as the closure used can easily adjust and secure the torso anchoring module 12 around the person's torso and be readily and quickly released with minimal effort. The positioning of the closure on the torso anchoring module when it is secured on the torso is not limited, as long as it is readily accessible for sealing and opening the device and does not interfere with the attachment of the resilient module and usage of the apparatus during exercise.

The dimensional length of the torso anchoring module can be any practical length for accommodating the girth of an adult, young adult or a child. Depending on the person's girth, the torso anchoring module can be expanded by mating two or more similarly configured torso anchoring modules, if necessary. For example, the hook and loop portion of the closure 14 disposed on the first free end portion 12*a* and the second free end portion 12*b* of the torso anchoring module illustrated in FIG. 1*c* can be mated with the respective mateable hook and loop portion of the closure of a second free end portion and first free end portion of a second similarly made torso anchoring module.

Also by way of illustration, and not limitation thereto, in FIG. 1, the limb extremity-receiving module 16 is configured somewhat similar to the torso anchoring module 12 in the form of a band or sling having a first free end 16*a* and a second free end 16*b*, a panel 17, and a closure 18. The limb extremity-receiving module 16 and the closure 18, respectively, can be constructed of the same types of materials as the torso anchoring module, and can include quick release fasteners as described above. Preferably, the limb extremity-receiving module 16 is dimensionally smaller in width and length than the torso anchoring module in width and length for receiving a person's hand or foot. Alternatively, the torso anchoring module and the limb extremity-receiving module can be similarly dimensioned so as to be interchangeable. For example, two or more similarly sized limb extremity-receiving modules, configured as illustrated in FIG. 1*c*, can be mated and expanded in a manner previously described to provide a torso anchoring module.

Preferably, for receiving a person's hand, the panel 17 of the extremity-receiving module 16 encircles the palm and top of the hand, as seen generally in FIGS. 6, 7, and 7*a*. For receiving a person's foot, the panel 17 of the extremity-receiving module 16 can encircle the sole and top of the foot, as shown generally in FIGS. 5, and 5*a*.

In FIG. 1, the resilient module 20 is illustrated in the form of an elongate, flexible, elastic cord that is looped at its proximal end 20*a* and its distal end 20*b*, but is not limited thereto. The resilient module can comprise an elongate, flexible, elastic band, cable, cord, or chain. The dimensional length of the resilient module can be any practical length, and an assortment of lengths can be provided. For example, an assortment of practical lengths can be about 6 inches, about 12 inches and about 18 inches. The level of resistive tension to be applied to a limb can be varied by selectively choosing a desired level of elasticity for the material used for the resilient module, the length of the resilient module, the degree to which it will be stretched, and the like. The level of tension of the resilient module can be adjusted independently from its length by using different materials of construction for the individual members.

A preferred resilient module embodiment can comprise a plurality of interchangeable elastic members, each elastic member having a different level of resistive tension. The resilient member can comprise a plurality of interconnecting elastic members, such as bands, cords, cables, chains or a combination thereof, placed in serial communication with each other so that the length and level of resistive tension of the resilient module preferably can be adjusted and linearly designed to accommodate the physique and the exercise need of the user. The resilient member or segment thereof can include indicia, such as a marking or color corresponding to a given level of resistance.

The modules of the apparatus illustrated in FIG. 1 can be placed in operative association with one another, as indicated by the arrows, by threading any one of the free end portions, 12*a*, 12*b*, of the resilient module 12 through the looped proximal end 20*a* and sliding proximal end 20*a* along the panel 13 of the torso anchoring module 12 to position the resilient module 20 for use with a right or left limb, as desired. Similarly, either one of free end 16*a* or 16*b* of extremity receiving module 16 can be threaded through looped distal end 20*b* of resilient module 20 and positioned along panel 17 of extremity-receiving module 16, as needed on the associated extremity of the same selected right or left limb. Thus, the proximal and distal end portions of the resilient module 20 are vertically aligned with one another along the lineal axis of the selected limb to be exercise.

Alternatively, the proximal end 20*a* of the elongated resilient module 20 can be knotted onto the panel 13 of torso anchoring module 12 by draping the proximal end 20*a* of resilient module 20 over panel 13 and passing the elongated resilient module 20 through the loop of proximal end 20*a*. If desired, the distal end of resilient module 20 can be likewise knotted on panel 17 of limb extremity-receiving module 16.

The limb extremity-receiving module can be in the form of a band or sling, as illustrated in FIG. 1, or can include a grip member, such as a ring, a bar, a stirrup, and the like. Alternatively, the sling can be a looped rope, strap or chain for cradling the limb extremity (hand or foot), and a grip member can be a substantially rigid ring, bar, or stirrup, which can be either solid, or have openings defined therein, such as illustrated in FIG. 4, which can be gripped by the person's hand or foot.

In an alternative modular apparatus embodiment, all or part of the proximal end portion of the resilient module can be sewn or fused to the torso anchoring module. Also, each of the resilient module and/or the torso anchoring module can include one or more clips, clasps, bolts, hooks, rivets, or other such fasteners for securing one or more resilient module(s) to the torso anchoring module.

Figure 1A:
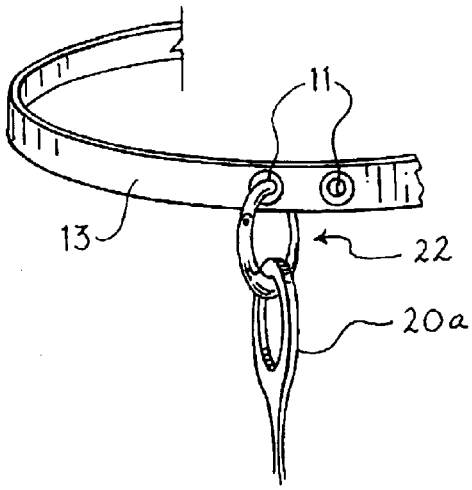
FIG. 1*a* is a partial, perspective view of a preferred torso anchoring module embodiment in operative association with a resilient module.
Figure 1B:
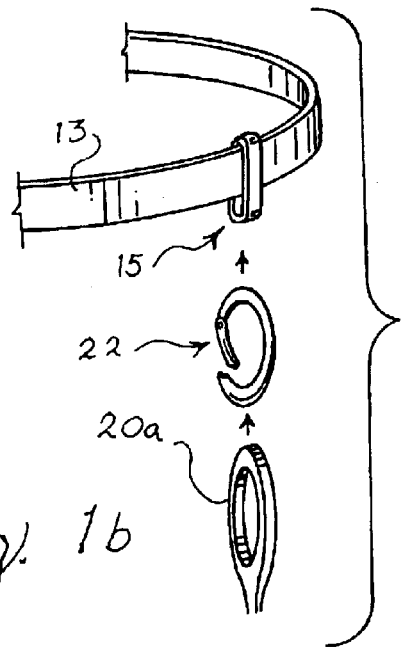
FIG. 1*b* is an exploded partial, perspective view of another preferred embodiment of a torso anchoring module, an attachment member, a connector module, and a resilient module.

In another modular apparatus embodiment illustrated, respectively, in FIGS. 1*a* and 1*b*, panel 13 of torso anchoring module 12 can include an attachment mount defined therein or disposed thereon for associating with resilient module 20. As shown in FIG. 1*a*, the attachment mount can be defined as one, or more, aperture 11, such as a punch hole, preferably reinforced with eyelets, in the panel 13, through which a connector module 22, such as a clip, can be attached for association with the proximal end 20*a* resilient module 20. Alternatively, as shown in FIG. 1*b*, the attachment mount on the panel 13 can comprise an attachment member, such as a loop or ring member 15, either slidably or fixedly disposed on the panel 13 to which the connector module 22 can be attached for association with the proximal end 20*a* of resilient module 20. A plurality of attachment mounts are preferred for adjusting and laterally positioning the proximal end portion of the resilient module on the torso anchoring module or for attaching each proximal end portion of a pair of resilient modules as seen in FIG. 4.

A combination of attachment mounts can be provided for adjusting the positioning of the proximal end portion of the resilient module or for attaching each proximal end portion of a resilient module having a pair of proximal ends. For example, a torso anchoring module can be in the form of a belt having a belt loop and a plurality of apertures defined on the belt's panel.

The connector module 22 can be any type of clip, clasp or hook that can receive the proximal end of the resilient module and secure it to the torso anchoring module. In another connector module aspect, the connector module can include a closure portion for the torso anchoring module. For example, the connector module can comprise an integral combination of buckle and clip where the buckle frame portion can be slidably received on the torso anchoring module. As illustrated in partial view in FIGS. 2 and 2*a*, where the torso anchoring module 12 has a band or belt-like panel 13, one portion of the connector module 24 can be configured as a buckle having a frame 25 and a tongue 26 and is affixed to the free end portion 12*a* of torso anchoring module 12. A second portion of the connector module 24 can be configured as a ring 28, such as a snap ring, to which the proximal end of a resilient module can be attached. Thus, the connector module 24 embodiment as shown in FIG. 2 can comprise an adjustable closure for the torso anchoring module 12 as illustrated in FIG. 2*a*, by providing the panel 13 with multiple apertures 11 defined therein for receiving the tongue 26 when the second free end portion 12*b* of torso anchoring module 12 is associated with the frame 25 of connector 24.

The features of the embodiments are illustrated in FIGS. 1*a*, 1*b*, 1*c*, 1*d*, 2, and 2*a* have been applied, for convenience, as applied to the torso anchoring module, but can be applied equally to the extremity-receiving module which, therefore, need not be separately illustrated and discussed. Similarly configured connector modules can be used for attaching the resilient module to the limb extremity-receiving module. In an alternative embodiment, either or both of the proximal or distal end portion of the resilient module can include a connector feature, such as a snap ring, integrally incorporated therein.

Either a single resilient module or a pair of resilient modules can be used to exercise a selected limb, as generally seen in FIGS. 5, 5*a*, 6, 7 and 7*a*. Where a pair of resilient modules of substantially identical length are used, as illustrated in partial view in FIG. 4, each resilient module, 20, 21, of the pair has a proximal end portion, 20*a*, 21*a*, and a distal end portion, 20*b*, 21*b*. Each of the proximal end portions, 20*a*, 21*a*, can be adapted for attachment to the torso anchoring module in parallel, substantially adjacent, spaced relationship to one another, and each of the distal end portions, 20*b*, 21*b*, can be adapted for attachment in substantially opposed spaced relationship to one another on the limb extremity-receiving module 16, and each one of the pair of resilient modules is aligned relative to the lineal axis of the limb to be exercised to provide a substantially uniform resistive tensive force to opposing sides of the limb during exercise.

As illustrated in FIG. 4, panel 13 of the torso anchoring module 12 can be provided with at least two spaced-apart attachment mounts defined therein, such as apertures 11, through which the proximal end portions, 20*a*, 21*a*, of the respective resilient modules 20, 21, can be independently attached to place them in substantially parallel relationship to one another. In the embodiment illustrated in FIG. 4, resilient modules 20 and 21 each includes an integral connector in proximal end portions, 20*a*, 21*a*. By way of illustration, and not limitation, the limb extremity-receiving module 16 illustrated in FIG. 4 includes a grip member 36 generally configured in the form of an open handle or stirrup having a substantially horizontal handrest or foot rest portion to provide an extremity contacting portion and outer portions, 36, 36*b*, that are angled substantially perpendicularly to the extremity contacting portion, the distal end portions, 20*b*, 21*b*, of the respective resilient modules, 20, 21, are loop shaped and attached to the limb extremity-receiving module by connectors, 22*a*, 22*b*, which in turn are respectively attached to the outer portions 36*a*, 36*b*, of the grip member 36 to maintain a substantially parallel relationship between the pair of resilient modules. The distance between the paired resilient modules is preferably spaced so that in use each resilient module independently lies vertically positioned on and in linear alignment with opposing sides of the selected limb, i.e., arm or leg.

If the user's torso or girth is such that the torso anchoring module may not be sufficiently stabilized when tension is applied during exercise, the torso anchoring module can include an auxiliary support member, such as a band or strap, having a first free end portion and a second free end portion, and is preferably adjustable. As illustrated in FIGS. 3 and 3*a*, respectively, the first free end portion 32 (shown in broken line) of the support member 30 can be attached to an anterior torso-contacting portion of the torso anchoring module 12 and the second free end portion 34 (shown in broken line) can be attached to a posterior torso-contacting portion of the torso anchoring module 12. As illustrated in the non-limiting embodiment of FIG. 3, the support member 30 for the torso anchoring module 12 used for exercising a lower limb can be configured to provide a supporting, truss-like, groin strap by passing the support member generally between the upper leg groin region from the anterior part of the body and angularly across the buttocks to the posterior (shown in hidden line) part of the body. As illustrated in the non-limiting embodiment of FIG. 3*a*, the support member 30 for a torso anchoring module 12 used for exercising an upper limb can be a shoulder strap. The shoulder strap can be either diagonally oriented as illustrated in FIG. 3*a* or can be substantially vertically oriented to provide a suspender-like strap. Alternatively, two support members can be used, positioned either vertically or crossed, to provide a harness-like torso anchor module, if desired.

The support member is preferably adjustable, and can be made of the same material as the body anchor module or can be made of a different material. Each of the free ends of the support member are preferably detachably attached to the torso anchor module. The support members can be detachably associated with the torso anchor module with quick release fasteners, such as clips, clasps, self-fastening tapes, such as VELCRO® tape, pins, and the like, or a connector module similar to the fasteners and connector modules described above. Each of the free ends of the support member are preferably attached to the torso anchoring module in a manner and position that does not directly contact or rub against the skin of the person to be exercised to minimize discomfort or irritation of the skin from pressure or abrasion during use. If desired, one or both of the free ends of the support member can be permanently secured, as by sewing or fusing, to the torso anchoring module. Thus, with minimal modification, the same torso anchoring module can be used for exercising either the upper limb muscles or the lower limb muscles.

For convenience, the resistive, limb-muscle exercise system of this invention can be assembled with all the modules attached before securing the torso anchoring module around the trunk of the person in need of exercising. If desired, a partial apparatus can be assembled composed of the torso anchoring module and the resilient module and then, after securing the torso anchoring module to the person, attaching the extremity receiving module. Alternatively, a partial apparatus can be assembled composed of the resilient module and extremity-receiving module and then attaching the partial apparatus to the torso anchoring module, either before or after the torso anchoring module is secured around the person's torso. For example, if a person prefers a belt of his or her own choosing from their wardrobe as the torso anchoring module, then a partial apparatus can be assembled composed of the resilient module attached at its distal end portion to a limb extremity-receiving module and the proximal end of the resilient module can subsequently be attached to the person's belt.

An exercise regimen can be initiated employing a resilient module having a desired level of resistance under tension until the limb-muscle strength increases. The initial resilient module then can be replaced with a subsequent resilient module having a greater or lesser level of resistive tension than the resilient member initially used for either further increasing limb-muscle strength or for maintaining fitness. Alternatively, the resilient module can comprise a chain comprising a plurality of interconnected elastic members, such as elastic bands, each segment of the chain providing the same or different levels of resistive tension. FIGS. 5 and 5*a* illustrate the use of a resilient module 20 comprising a chain of interconnected elastic bands in which each segment of the chain has an interconnecting point 23.

FIGS. 5, 5*a*, 6, 7 and 7*a* illustrate various exercises using the modular, resistive limb-muscle exercise system. One resilient module can be used to exercise a limb, as generally illustrated in FIGS. 5, 5*a*, 6, 7, and 7*a*, and discussed in more detail below. Alternatively, a pair of resilient modules can be used to exercise a limb, each member of the pair being independently, linearly positioned to provide resistive tension to opposing sides of the limb during use.

The extremity-receiving module for exercising the limb muscles of the upper limbs of elderly persons or bedridden persons, and the like, having feeble hand or finger grasping strength preferably is configured and dimensioned to encircle the hand, for example in the form of a flexible sling cradling the palm, as generally shown in FIGS. 6, 7, and 7*a*. The flexible sling thus provides the person the ability to use the entire weight of the hand to push or pull for achieving resistive tension to the entire upper limb or alternatively, to only exercise the wrist and hand (such as by flexing and rotating the wrist or hand). Where the person has a sufficiently robust hand or finger grasp, the extremity-receiving module can include a grip member that is configured and dimensioned for grasping with the fingers, such as a rigid bar or ring, and the like.

Likewise, the extremity-receiving module for exercising the limb muscles of the lower limbs of elderly persons or bedridden persons, and the like, having feeble foot strength preferably is configured and dimensioned to encircle the foot, for example in the form of a flexible sling, for securely cradling the sole and top of the foot, as generally seen in FIGS. 5 and 5*a*. The flexible sling thus provides the person the ability to use the entire weight of the foot to push for achieving resistive tension to the entire lower limb or to only exercise the ankle and foot (such as by flexing and rotating the ankle or foot). Where the person has sufficient foot strength, the extremity-receiving module can include a grip member that is configured and dimensioned for grasping by the foot or toes, such as a stirrup, rigid bar, rigid ring, and the like. In the grip member 36 embodiment illustrated in FIG. 4, for example, the user can grip the extremity receiving module 16 either by placing his or her fingers or toes through the defined opening of the grip member 36 and grasping the apparatus or by supporting the palm of the hand or sole of the foot on the handrest or footrest portion provided on the grip member 36, whichever is more comfortable.

The extremity-receiving module can also provide additional muscle resistive force by including weights, or being adapted to include weights attached thereto or suspended therefrom. For example, the extremity-receiving module can be configured in the form of a band or sling having a pocket or compartments defined therein for releasably receiving weight members, such as metal or plastic slugs, discs, and the like. Thus the resistive tension can be increased before or during the exercise regimen without changing the resilient module or in addition to varying the resilient module. Alternatively, grip members of varying weight can be provided or the extremity-receiving module can be adapted for attaching weights thereto. Useful weights can vary from ounces to pounds, preferably in the range of about one to about ten pounds. Thus, one or more of the foregoing weight members can be employed to tailor the resistive exercise system to the need of the user.

The grip members can be molded or textured to facilitate grasping by the person's hand or foot. Useful grip members can be made of any material that is substantially non-toxic, and non-irritating to human skin, such as wood, plastic, rubber, metal, such as aluminum, stainless steel, and the like. The grip member and limb extremity-receiving module can be manufactured as a single unit as illustrated by the embodiment in FIG. 4, or can be manufactured as separate units to be attached to the limb extremity-receiving module.

A preferred method embodiment of exercising a limb-muscle with the modular resistive limb-muscle exercise system comprises the following steps.

(i) A torso anchoring module (a), a resilient module (b), and limb extremity-receiving module (c) are placed in operative association with one another. The length and resiliency of the resilient module is selected to provide a predetermined level of resistive tension when tension is applied between modules (a) and (b) in performing step (iv).

(ii) The torso anchoring module (a) is secured around a portion of the torso of a person in need of exercise and the resilient module is vertically aligned with the lineal axis of the selected limb to be exercised. This step can be performed by either the user or the caregiver of the person to be exercised.

(iii) The person's limb selected to be exercised is then placed in flexion relationship with the person's body and the associated limb extremity is received in the extremity-receiving module (b), while maintaining the resilient module slack so that substantially no tension is applied between modules (a) and (b). FIGS. 5 and 7, respectively, illustrate the starting flexion position for exercising a lower limb and an upper limb with one embodiment of the resistive exercise system.

(iv) Variable tension is then applied to the resilient module associated with modules (a) and (b) by extending and flexing the selected limb repeatedly and sufficiently to provide a discernable resistive tension to the muscles of the selected limb. This step is illustrated by the directional arrow in FIGS. 5 and 5*a* for exercising a lower limb and by the directional arrow in FIGS. 7 and 7*a* for exercising an upper limb exercise regimen.

FIGS. 5 and 5*a* illustrate the modular resistive limb-muscle exercise system of this invention is use for exercising the muscles of a lower limb, i.e., a leg. In FIG. 5, the torso anchoring module 12 is in the form of a band or belt positioned on the user's torso at about the hip, the selected leg is placed in starting flexion relationship with the user's body, and the associated foot is received in the extremity-receiving module 16, also illustrated in the form of a band or belt, with no tension applied to the resilient module 20. In the non-limiting embodiments shown in both FIGS. 5 and 5*a*, the resilient module 20 comprises a chain of interconnected elastic bands that have interconnecting points 23. The proximal end portion 20*a* is operably associated with the torso anchoring module 12 by a connector module 22 attached to a loop member 15 disposed on the panel 13 of the torso anchoring module 12, and the distal end portion 20*b* is similarly operably associated with the extremity-receiving module 16 by a connector module 22 attached to a loop member 15 disposed on the panel 17 of the limb extremity-receiving module 16. FIG. 5*a* illustrates the extension of the leg placing resistive tension on the resilient module 20 as indicated by the directional arrows.

FIGS. 7 and 7*a* illustrate the modular resistive limb-muscle exercise system of this invention is use for exercising the muscles of an upper limb, i.e., arm. In FIG. 7, the torso anchoring module 12 is in the form of a band or belt positioned on the user's torso at about midchest and selected arm is placed in starting flexion relationship with the user's torso, and the associated hand is received in the extremity-receiving module 16, also illustrated in the form of a band or belt, with no tension applied to the resilient module 20. In the non-limiting embodiments shown in both FIGS. 7 and 7*a*, the resilient module 20 comprises an elastic cord. The proximal end portion 20*a* is loop-shaped and is operably associated with the torso anchoring module 12 by a connector module 22 attached to the panel 13 of the torso anchoring module 12, and the distal end portion (not shown) is similarly configured and operably associated with the panel 17 of the extremity-receiving module 16. FIG. 7*a* illustrates the extension of the arm placing resistive tension on the resilient module 20 as indicated by the directional arrow.

FIG. 6 illustrates another exercise for an upper limb muscle, particularly for rehabilitating shoulder-cuff injuries. In the non-limiting embodiment illustrated, the panel 13 of the torso anchoring module is generally aligned on the user's trunk to be near or at about the elbow of the selected arm, the proximal end portion 20*a* of the resilient module 20 is loop shaped and is attached to the panel 13 by the connector 22 so it is located in generally opposing relationship with the elbow. The distal end portion 20*b* of the resilient module 20 can also be loop shaped and is attached by a connector 22 to the panel 17 of the extremity receiving module 16. As indicated by the directional arrow shown in solid and broken lines, this exercise can be performed two ways. In one exercise aspect, the arm is initially placed in flexion relationship with the torso, the distal end 20*b* of the resilient member 20 is positioned on panel 17 on the palm side, and then starting with the hand positioned near the proximal end portion 20*a* of the resilient module 20, tension is applied to resilient module 20 by pushing the arm laterally away from the torso with the resilient module 20 passing over the torso, as shown by the direction arrow in solid line.

Alternatively, as shown in hidden lines in FIG. 6, the proximal end portion 20*a* of resilient module 20 can be positioned to pass under or behind the torso and, with the arm placed in flexion relationship to the torso, the distal end portion 20*b* is positioned on the topside or back-of-the hand portion of panel 17, in which case, tension is applied to the resilient module 20 by pulling the arm laterally inwardly across the torso, as indicated by the directional arrow shown in broken line. The exercises portrayed in FIGS. 5, 5*a*, 6, 7, and 7*a*, can also be performed in substantially the same way employing a pair of resilient modules, as previously described. In an exercise regimen, the limb can be repeatedly flexed and extended until the desired amount of limb-muscle exercise is achieved.

The exercise method can further include varying the resistive tension provided by initiating the exercise with a resilient module (c) having one level of resistive tension and then replacing the resilient module (c) with a resilient module having a greater or lesser level of resistive tension than the resilient module initially used. Alternatively, the resistive tension can be provided by initiating the exercise with an extremity-receiving module including a grip member having a selected weight and then varying the weight of the grip member. Thus, the variable resistive tension can be periodically or incrementally increased to tailor the exercise apparatus to the need of the person.

In another method aspect, the anchor module (a) can be a belt provided by the user from his or her own wardrobe, where the panel of the belt has punch holes or belt loops of suitable configuration, dimension or strength for attaching an apparatus comprised of the resilient module (c) operably associated with an extremity-receiving module (b) as previously described.

The foregoing method is particularly suitable for exercising a person in a prone, recumbent position on a bed or mat so that the torso anchoring module is further stabilized by the person's own body weight. The method can also be practiced by a person in a sitting position, such as a chair or wheelchair. Alternatively, the method can be practiced standing up, if the person so wishes.

The modular resistive limb-muscle exercise system can be used to exercise either one limb at a time or simultaneously exercise more than one limb at a time, for example, both arms or an arm and a leg or both arms and both legs. The modular resistive limb-muscle exercise system can be used in the privacy of a person's home or office. Additionally, the apparatus of the modular resistive limb-muscle exercise system can be used by the person in need of exercise by alone or with the aid of a caregiver.

The modular resistive limb-muscle exercise system can be provided in packaged form, preferably as a kit, containing each of the modules of the apparatus in disassembled form with instructional indicia for assembly thereof. Alternatively, the apparatus can be provided with some or all of modules in assembled form. An assortment of resilient modules can be provided for use, such as, e.g.: one for each arm; a pair for each arm; one for each arm and leg; or pair for each arm and leg. Additionally, the provided extremity-receiving module can include various types of grip members and connector modules for adapting the resilient modules to various shaped grip members. For example, the proximal end portions of paired resilient modules can be attached to the torso anchoring module and the distal end portions of the paired resilient modules can be adapted to be attached either to a common point on the extremity-receiving in opposed spaced relationship, i.e., on opposing edges of a grip member, such as a bar-shaped grip member or stirrup. The kit preferably also includes a storage unit for the apparatus.

The instructional indicia can be printed media, aural media, visual aids, electronic media or a combination thereof, which instruct the user on how to assemble the modular apparatus and a describe beneficial exercises that can be performed with the modular exercise system. Printed media includes, but is not limited to, labels, pamphlets, books, flyers and the like. Aural media includes, but is not limited to, tape recordings, audio compact disks, records, and the like. Visual aids include, but are not limited, to photographs, slides, movies, videos, DVDs, and the like. Electronic media includes all forms of electronic data storage media, such as, but not limited to, diskettes, interactive CD-ROMs, interactive DVDs, and the like.

The modular apparatus of the limb-muscle exercise system provides versatility in its usage, as well as portability, ease of assembly, and storage.

Although the present invention has been described in detail in terms of preferred embodiments, no limitation of the scope of the invention is intended.

I claim:

1. A modular, resistive, limb-muscle exercise system comprising:

(a) a torso anchoring module configured for encircling and being adjustably secured around a portion of a person's torso;

(b) a limb extremity-receiving module; and (c) at least one elongate resilient module having a proximal portion and a distal portion, the resilient module being adapted for placing the proximal portion in operative association with the torso anchoring module and for placing the distal portion in operative association with the limb extremity-receiving module to provide variable, resistive tension to the muscles of a limb during exercise;

the elongate resilient module consisting essentially of an elastic chain comprising a plurality of detachable interconnecting elastic links, the number and elasticity of the links being variable for adjusting the length and resistive force of the elongate resilient module.

2. The exercise system of claim 1 wherein the torso anchoring module includes a releasable, sealable closure.

3. The exercise system of claim 1 wherein either one or both of the torso anchoring module and limb extremity-receiving module includes at least one attachment mount for associating the resilient module therewith.

4. The exercise system of claim 1 wherein the torso anchoring module further comprises at least one support member having a first end portion attachable to an anterior torso-contacting portion of the torso anchoring module and a second end portion attachable to a posterior torso-contacting portion of the torso anchoring module.

5. The exercise system of claim 4 wherein the support member is an adjustable shoulder strap.

6. The exercise system of claim 4 wherein the support member is an adjustable groin strap.

7. The exercise system of claim 1 wherein the limb extremity-receiving module includes a grip member.

8. The exercise system of claim 7 wherein the grip member is in the form of a sling, a ring, a bar, or a stirrup.

9. The exercise system of claim 1 wherein the extremity-receiving module includes a weight or is adapted to releasably receive a weight member therein or releasably attached thereto.

10. The exercise system of claim 1 further including at least one connector module for placing either the proximal portion of the elongate resilient module in operative association with the torso anchoring module, or the distal portion of the elongate resilient module in operative association with the limb extremity-receiving module.

11. The exercise system of claim 1 wherein the torso anchoring module comprises an adjustable band or belt, the limb extremity-receiving module comprises a grip member, and the elongate resilient module comprises a pair of substantially identical resilient modules, each member of the pair having a proximal portion adapted for association in parallel substantially adjacent spaced relationship to one another on the torso anchoring module, and having a distal portion adapted for association in parallel substantially opposed spaced relationship to one another on the grip member of the limb extremity-receiving module.

12. An exercise apparatus comprising the limb-muscle exercise system of claim 1 wherein the torso anchoring module is operatively associated with the proximal portion of an elongate resilient module and the distal portion of the elongate resilient module is in operative association with a limb extremity-receiving module.

13. An article of manufacture comprising a kit containing a modular exercise system of claim 1 in disassembled form with instructional indicia for assembly and use thereof.

14. The article of manufacture of claim 13 wherein the instructional indicia are selected from the group consisting of printed media, aural media, visual aids, electronic media, and a combination thereof.

15. The exercise system of claim 1 in partially or wholly assembled form.

* * * * *